US009056347B2

(12) United States Patent
Eguchi et al.

(10) Patent No.: US 9,056,347 B2
(45) Date of Patent: Jun. 16, 2015

(54) PRESS-DIE AND PRESS WORKING METHOD

(75) Inventors: Hiroyuki Eguchi, Tochigi (JP); Toshifumi Matsuda, Tochigi (JP); Kazuya Saito, Tochigi (JP); Jiro Watanabe, Tochigi (JP); Kohei Teshima, Tochigi (JP); Michio Nakamura, Tochigi (JP); Masayasu Nishida, Tochigi (JP); Ken Hashimoto, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 269 days.

(21) Appl. No.: 13/885,082

(22) PCT Filed: Nov. 15, 2011

(86) PCT No.: PCT/JP2011/076317

§ 371 (c)(1),
(2), (4) Date: May 13, 2013

(87) PCT Pub. No.: WO2012/067122

PCT Pub. Date: May 24, 2012

(65) Prior Publication Data

US 2013/0228000 A1 Sep. 5, 2013

(30) Foreign Application Priority Data

Nov. 16, 2010 (JP) ..... 2010-255536

(51) Int. Cl.
*B21D 24/16* (2006.01)
*B21D 22/20* (2006.01)

(Continued)

(52) U.S. Cl.
CPC ..... *B21D 24/16* (2013.01); *B21D 22/20* (2013.01); *B21D 24/04* (2013.01); *B21D 37/08* (2013.01)

(58) Field of Classification Search
CPC ..... B21D 22/02; B21D 22/10; B21D 22/20; B21D 22/21; B21D 22/22; B21D 24/02; B21D 24/04; B21D 37/08
USPC ..... 72/330, 334, 337, 347, 350
See application file for complete search history.

(56) References Cited

U.S. PATENT DOCUMENTS 5,016,458 A 5/1991 De Smet
5,067,336 A 11/1991 de Smet (Continued)

FOREIGN PATENT DOCUMENTS

CN 2659584 12/2004
CN 1943900 4/2007
DE 3218923 12/1982

(Continued)

*Primary Examiner* — Debra Sullivan
(74) *Attorney, Agent, or Firm* — Rankin, Hill & Clark LLP

(57) ABSTRACT

A press-die is provided with a lower die and an upper die. The lower die includes a drawing punch, a blank holder, and a cushion part. The upper die includes a drawing die part, and a trimming part. The blank holder includes a first holder part disposed to face to an end portion of the drawing die part, and a second holder part disposed to face to the trimming part. The second holder part has a drawing support portion that supports a first portion of a bottom surface of the first holder part. The drawing punch has a trimming support portion that supports a second portion of the bottom surface of the first holder part. The first holder part has a lower trimming blade at an outer edge thereof. The trimming part has an upper trimming blade at an inner edge thereof.

3 Claims, 9 Drawing Sheets

(51) Int. Cl.
*B21D 24/04* (2006.01)
*B21D 37/08* (2006.01)

(56) References Cited

U.S. PATENT DOCUMENTS

| | | | | |
|---|---|---|---|---|
| 2002/0095968 | A1* | 7/2002 | Matsunaga | 72/350 |
| 2011/0100085 | A1* | 5/2011 | Kubo | 72/350 |

FOREIGN PATENT DOCUMENTS

| | | | |
|---|---|---|---|
| JP | S62-3217 | U | 1/1987 |
| JP | H04-17322 | U | 2/1992 |
| JP | 11-290951 | | 10/1999 |
| JP | 2000-233234 | | 8/2000 |
| JP | 2004-034145 | | 2/2004 |
| JP | 2004-314147 | | 11/2004 |

* cited by examiner

PRESS-DIE AND PRESS WORKING METHOD

TECHNICAL FIELD

The invention relates to a press-die and a press working method.

BACKGROUND ART

A press-die for performing drawing process and trimming process on a workpiece is used in manufacturing of a panel or the like of an automobile (e.g., see Patent Document 1). A lower die of the press-die disclosed in Patent Document 1 includes a punch (lower forming die) facing to a die (upper forming die) of an upper die. A pressing member and a receiving member as a blank holder for supporting the workpiece are provided around the punch. The receiving member is disposed to be slidable with respect to a side surface of the punch, and the pressing member is disposed to be slidable with respect to a side surface of the receiving member.

PRIOR ART DOCUMENT

Patent Document

Patent Document 1: JP-A-2004-314147

The receiving member and the pressing member are disposed to face to a trimming part (pressing frame) of the upper die, in which the receiving member is biased toward the trimming part by a cushion part (cylinder rod and hydraulic cylinder) for the receiving member, and the pressing member is biased toward the trimming part by a cushion part (cylinder rod and biasing means) for the pressing member. A lower trimming blade (lower blade) is provided at a receiving-member-side end portion of the punch, and an upper trimming blade (upper blade) is provided at a die-side end portion of the trimming part.

In the press-die, the workpiece is disposed on a top surface of the pressing member in an initial state. When the upper die is moved down by a press ram, the workpiece is sandwiched between the trimming part of the upper die and the press member. When the upper die is further moved down, the trimming part and the press member are moved down in the state in which the workpiece is sandwiched therebetween. The workpiece is pressed toward the punch and the receiving member by the die, so that the workpiece is drawn-shaped.

Subsequently, when the upper die is moved down, the trimming portion pushes the receiving member and the press member downward. Therefore, the trimming part is moved down relative to the die, and an upper trimming blade and a lower trimming blade are exposed, so that the workpiece is cut by the blades, which performs a trimming process.

However, since the receiving member and the press member are supported by separated cushion parts, the following problems may occur. That is, a load applied to the workpiece may be different at the receiving member and the press member during the drawing process. Further, in the case where the workpiece is creased during the drawing process, the cylinder biasing the receiving member is contracted, and a difference in level is formed between the top surfaces of the punch and the receiving member, so that an inflow resistance of a workpiece material may be increased. For this reason, it may cause the quality of draw-formed product to deteriorate. In addition, since an edge of the lower trimming blade is exposed during the drawing process, the edge is shaved and worn by the workpiece when the workpiece material flows in. In this instance, the workpiece is also shaved by the edge of the lower trimming blade, so that the formed product may be damaged thereby to exert an adverse effect on the appearance of the product.

Further, after the trimming process, even though the receiving member and the press member are moved up to return it to the initial position, the formed product is left on the punch, so that it is difficult to extract the formed product.

SUMMARY OF INVENTION

The present invention relates to a press-die and a press working method which can improve a quality of a formed product.

In accordance with embodiments of the invention, a press-die 100, 100A may include a lower die 101 that supports a workpiece W, and an upper die 102 disposed to face to the lower die 101.

The lower die 101 may include a drawing punch 120, a blank holder 130 disposed to be movable along a side surface of the drawing punch 120, and a cushion part 140 pressing the blank holder 130 toward the upper die 102.

The upper die 102 may include a drawing die part 160 disposed to face to the drawing punch 120, and a trimming part 180 disposed to be movable along a side surface of the drawing die part 160.

The blank holder 130 may include a first holder part 131 disposed to face to an end portion 162 of the drawing die part 160, and a second holder part 132 disposed to face to the trimming part 180 and biased by the cushion part 140.

The second holder part 132 may include a drawing support portion 133 that supports a first portion 131A of a bottom surface of the first holder part 131.

The drawing punch 120 may include a trimming support portion 123 that supports a second portion 131B of the bottom surface of the first holder part 131.

The first holder part 131 may include a lower trimming blade 191 at an outer edge thereof.

The trimming part 180 may include an upper trimming blade 192 at an inner edge thereof.

Moreover, in accordance with embodiments of the invention, a press working method may include a drawing process on a workpiece W by moving an upper die 102 toward a lower die 101 so that the workpiece W is sandwiched between a top surface of a first holder part 131 of the lower die 101 and a bottom surface of an end portion 162 of a drawing die part 160 of the upper die 102 and between a top surface of a second holder part 132 of the lower die 101 and a bottom surface of a trimming part 180 of the upper die 102, and the drawing punch 120 of the lower die 101 is inserted into a concave portion 161 of the drawing die part 160, and a trimming process on the workpiece W, after the drawing process, by a lower trimming blade 191 of the first holder part 131 and an upper trimming blade 192 of the trimming part 180, by moving the upper die 102 toward the lower die 101 so that the trimming part 180 is moved toward the lower die 101 relative to the drawing die part 160 and the second holder part 132 is moved together with the trimming part 180.

During the drawing process, in a state in which a first portion 131A of a bottom surface of the first holder part 131 is supported by a drawing support portion 133 of the second holder part 132, the first holder part 131 may be moved toward a trimming support portion 123 of the drawing punch 120 by the drawing die part 160, and the second portion 131B of the bottom surface of the first holder part 131 may abut on the trimming support portion 123 when the drawing is completed.

During the trimming process, the second portion 131B of the bottom surface may be supported by the trimming support portion 123, and the first portion 131A of the bottom surface may be spaced apart from the drawing support portion 133.

BRIEF DESCRIPTION OF DRAWINGS

FIG. 1 is a side sectional view schematically illustrating a configuration of a press-die according to a first embodiment of the present invention.

FIG. 2 is a side sectional view illustrating an operating state of the press-die in FIG. 1.

FIG. 3 is a side sectional view illustrating the operating state of the press-die subsequent to the process illustrated in FIG. 2.

FIG. 4 is a side sectional view illustrating the operating state of the press-die subsequent to the process illustrated in FIG. 3.

FIG. 5 is a side sectional view illustrating the operating state of the press-die subsequent to the process illustrated in FIG. 4.

FIG. 6 is a side sectional view illustrating the operating state of the press-die subsequent to the process illustrated in FIG. 5.

FIG. 7(*b*) is a view corresponding to a cross-sectional view taken along the line A-A in FIG. 1 to illustrate a modification of a portion of the configuration of the press-die in FIG. 1.

FIG. 8 is a side sectional view schematically illustrating the configuration of a press-die according to a second embodiment.

FIG. 9 is a side sectional view illustrating an operating state of the press-die in FIG. 8.

DESCRIPTION OF EMBODIMENTS

Embodiments will now be described referring to drawings. Further, the embodiments are exemplifications of the invention, and a scope of the invention does not limited by the embodiments. Features and combinations thereof described in the embodiments are not0 necessarily essential to the invention.

(1) Configuration of Press-Die According to Embodiment 1

Figure 1:
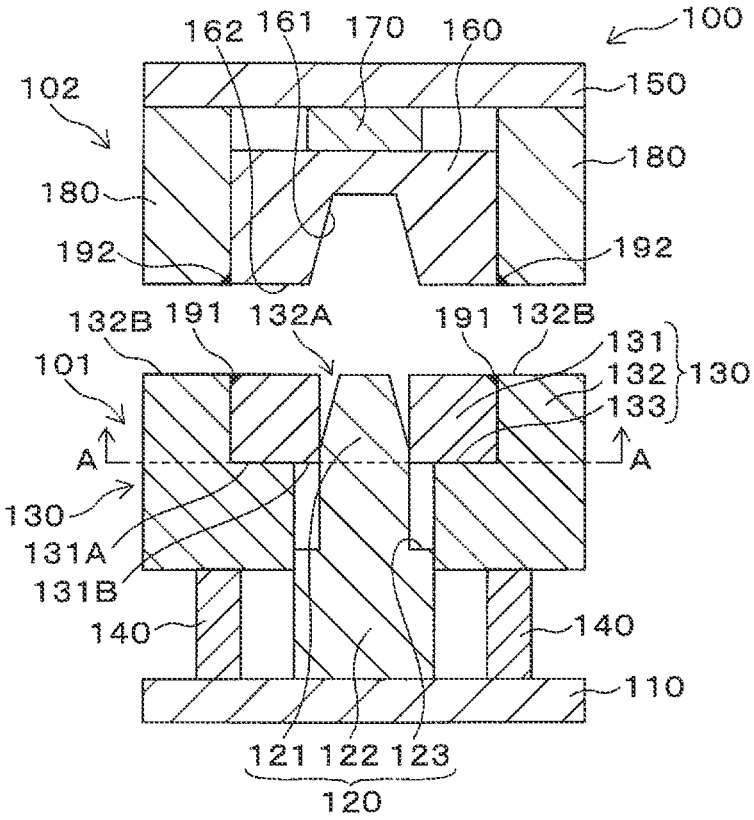
[FIG. 1]

FIG. 1 is a side sectional view schematically illustrating the configuration of a press-die 100 of a first embodiment. The press-die 100 includes a lower die 101 supporting the workpiece, and an upper die 102 disposed to face to the lower die 101.

The lower die 101 has a lower die support part 110, a punch 120 (drawing punch), a blank holder 130, and a cushion part 140. The punch 120 is fixed on the lower die support part 110. The punch 120 has, for example, a small-width portion 121 and a large-width portion 122. The small-width portion 121 has a tip portion which is inserted into a concave portion 161 of a die part 160 (drawing die part). The large-width portion 122 is formed on a lower end of the small-width portion 121, and has a width larger than that of the small-width portion 121. A boundary portion at sides of the small-width portion 121 and the large-width portion 122 is provided with a trimming support portion 123 for supporting a first holder part 131 of the blank holder 130 at the time of the trimming process. The trimming support portion 123 is, for example, a flat stepped portion.

The blank holder 130 is installed to be movable along a side surface of the punch 120. The blank holder 130 has a first holder part 131 and a second holder part 132. The first holder part 131 is disposed to be slidably moved along the side surface of the small-width portion 121 of the punch 120. An inner portion of a bottom surface (second portion 131B of the bottom surface) of the first holder part 131 is disposed at a predetermined interval from a top surface of the trimming support portion 123 of the punch 120 at an initial state, and abuts on the top surface of the trimming support portion 123 at the time of the trimming process. A top surface of the first holder part 131 is provided with a lower trimming blade 191 at an outer edge thereof.

A lower portion of the second holder part 132 is disposed to be slidably moved along the side surface of the large-width portion 122 of the punch 120. A center portion of the second holder part 132 is provided with a hole 132A, and the punch 120 is disposed in the hole 132A. A drawing support portion 133 is formed on the hole 132A to support an outer portion of the bottom surface (first portion 131A of the bottom surface) of the first holder part 131 at the time of the drawing. The drawing support portion 133 is, for example, a stepped portion formed on the upper portion of the hole 132A. A scrap which is cut from the workpiece W at the trimming process is disposed on the top surface of an end portion 132B outside the hole 132A of the second holder part 132.

Figure 7A:
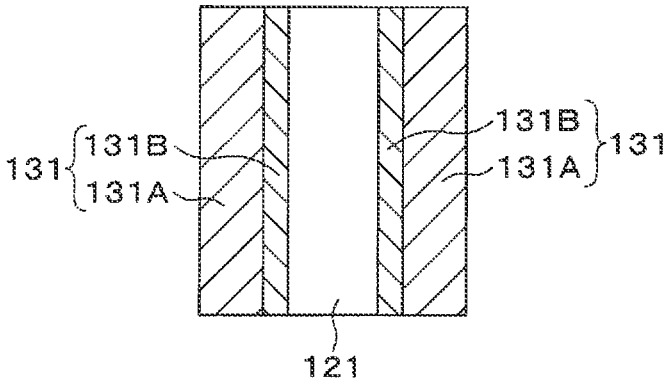
[FIG. 7] FIG. 7(*a*) is a cross-sectional view taken along the line A-A in FIG. 1 to illustrate a portion of the configuration of the press-die in FIG. 1.

FIGS. 7(*a*) and 7(*b*) are cross-sectional views taken along the line A-A in FIG. 1, in which FIG. 7(*a*) shows a portion of the configuration of the press-die in FIG. 1, and FIG. 7(*b*) is a view illustrating a modification of a portion of the configuration of the press-die in FIG. 1. In FIGS. 7(*a*) and 7(*b*), there is shown only the small-width portion 121 of the punch 120 and the first holder part 131. In the first embodiment, for example, the region of the first holder part 131 is divided into an outer side and an inner side, as illustrated in FIG. 7(*a*), in which the outer bottom surface serves as the first portion 131*a* of the bottom surface which is supported by the second holder part 132 at the drawing, and the inner bottom surface serves as a second portion 131*b* of the bottom surface (portion of the bottom surface except for the first portion 131*a*) which is supported by the punch 120 at the trimming process. The present invention is not limited thereto, and various modifications or variations are available.

Figure 7B:
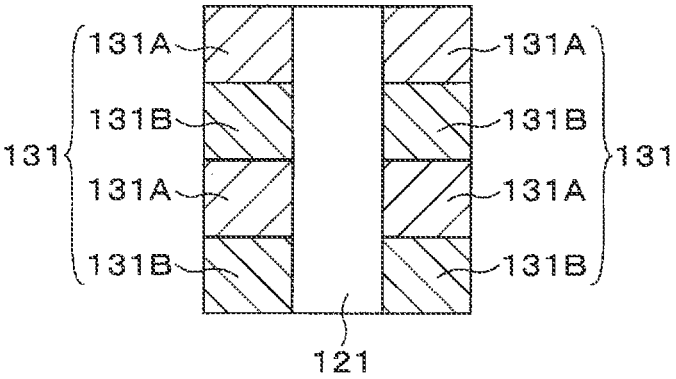

For example, the region of the first holder part 131 is divided along a horizontal direction of a plane which is slid on the punch 120, as illustrated in FIG. 7B, and the first portion 131A of the bottom surface supported by the second holder part 132 at the drawing and the second portion 131B of the bottom surface supported by the punch 120 at the trimming process may be alternatively provided. In this instance, the shapes of the drawing support portion 133 of the second holder part 132 and the trimming support portion 123 of the punch 120 are set along the regions of the first portion 131A of the bottom surface and the second portion 131B of the bottom surface. Although the blank holder 130 is installed to be sandwiched between a pair of lateral portions of the punch 120 in the aspect illustrated in FIGS. 7(*a*) and 7(*b*), the present invention is not limited thereto. The blank holder may be installed to enclose the whole circumference of the lateral portion of the punch 120.

The cushion part 140 biases, for example, the second holder part 132 of the blank holder 130 toward a trimming part 180. The cushion part 140 includes, for example, a hydraulic cylinder and a cylinder rod. The hydraulic cylinder (not illustrated) is installed at the bottom surface of the lower die support part 110, and the cylinder rod penetrates the hole of the lower die support part 110 and is fixed to the lower end of the second holder part 132. The cylinder rod is slidably supported in the cylinder rod, and is imparted by, for example, a hydraulic pressure in the hydraulic cylinder. The blank holder 130 can be moved up and down by expansion and contraction of the cushion part 140.

The upper die 102 includes an upper die support part 150, a die part 160, a cushion part 170, and the trimming part 180. The die part 160 is supported by the upper die support part 150 via the cushion part 170. A top surface of the die part 160 is disposed at a predetermined interval from the bottom support of the upper die support part 150. A center portion of the bottom surface of the die part 160 is formed with a concave portion 161 to which the tip portion of the punch 120 is inserted. An outside end portion 162 of the concave portion 161 on the bottom surface of the die part 160 is facing to the first holder part 131 of the blank holder 130.

The cushion part 170 supports the die part 160. The cushion part 170 includes, for example, a hydraulic cylinder and a cylinder rod. The hydraulic cylinder (not illustrated) is installed on a top surface of the upper die support part 150, and the cylinder rod penetrates the hole of the upper die support part 150 and is fixed to the top surface of the die part 160. The cylinder rod is slidably supported in the cylinder rod, and is imparted by, for example, a hydraulic pressure in the hydraulic cylinder.

The trimming part 180 is disposed at the outside of the die part 160, and is fixed to the upper die support part 150. The trimming part 180 is slidably moved along the side surface of the die part 160, and is movable up and down relative to the die part 160 by the expansion and contraction of the cylinder rod of the cushion part 170. The bottom surface of the trimming part 180 is facing to the top surface of the second holder part 132. The bottom surface of the trimming part 180 is provided with an upper trimming blade 192 at an inner edge thereof.

(2) Operation of Embodiment 1

The press working method using the press-die 100 will be described with reference to FIGS. 2 to 6. FIGS. 2 to 6 are side sectional views illustrating the operating state of the press-die 100.

Figure 2:
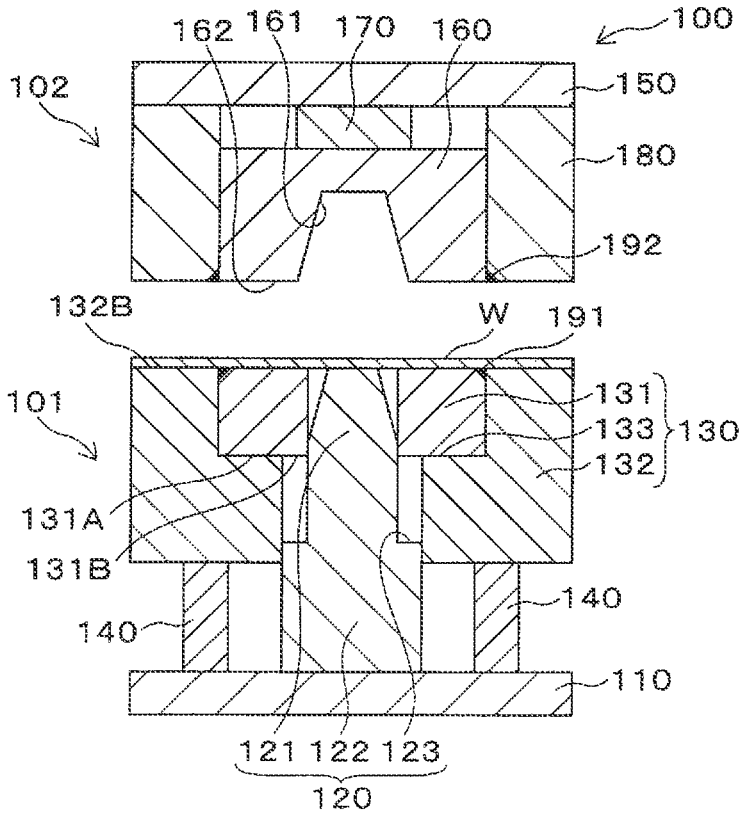
[FIG. 2]

First, as illustrated in FIG. 1, after the upper die 102 is positioned at a top dead center and the press-die 100 is set as the initial state, the workpiece W is disposed on the lower die 101, as illustrated in FIG. 2.

In the initial state of the press-die 100, as illustrated in FIGS. 1 and 2, for the lower die 101, the second holder part 132 of the blank holder 130 is biased upward by the cushion part 140, and thus is positioned at the uppermost position. The outer portion of the bottom surface (the first portion 131A of the bottom surface) of the first holder part 131 is supported by the drawing support portion 133 of the second holder part 132, and the inner portion of the bottom surface (the second portion 131B of the bottom surface) of the first holder part 131 is spaced apart from the top surface of the trimming support portion 123 of the punch 120. In this instance, for example, the top surface of the first holder part 131, the top surface of the end portion 132B of the second holder part 132, and the top surface of the punch 120 configures the same plane, so that the lower trimming blade 191 is not exposed. The upward biasing force of the cushion part 140 is set to be lower than the pressure of the drawing, for example.

Meanwhile, for the upper die 102, the die part 160 is positioned at the lowermost position, and the bottom surface of the end portion 162 of the die part 160 and the bottom surface of the trimming part 180 configure the same plane, so that the upper trimming blade 192 is not exposed. The downward biasing force of the cushion part 170 is set to be higher than the pressure of the drawing, for example.

Figure 3:
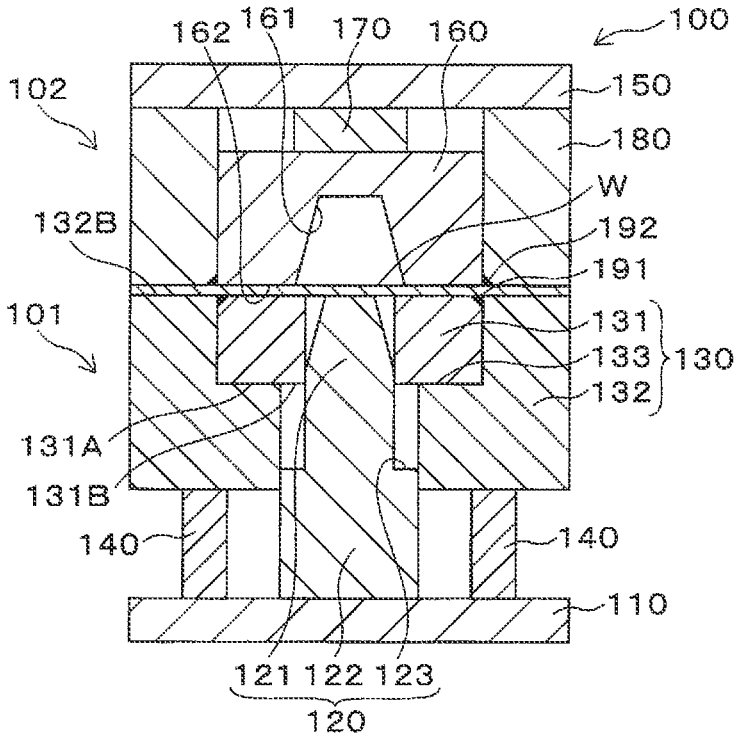
[FIG. 3]

Subsequently, when the upper die 102 is moved down, as illustrated in FIG. 3, the workpiece W is sandwiched by the blank holder 130 of the lower die 101, the end portion 162 of the die part 160 of the upper die, and the trimming part 180. Then, when the upper die 102 is moved down, the cushion part 140 of the lower die 101 starts to shrink, and the blank holder 130 is moved down together with the upper die 102. Thus, the workpiece W is pressed to the punch 120 by the concave portion 161 of the die part 160, thereby performing the drawing. Accordingly, a draw-formed portion is formed at the center portion of the workpiece W.

Figure 4:
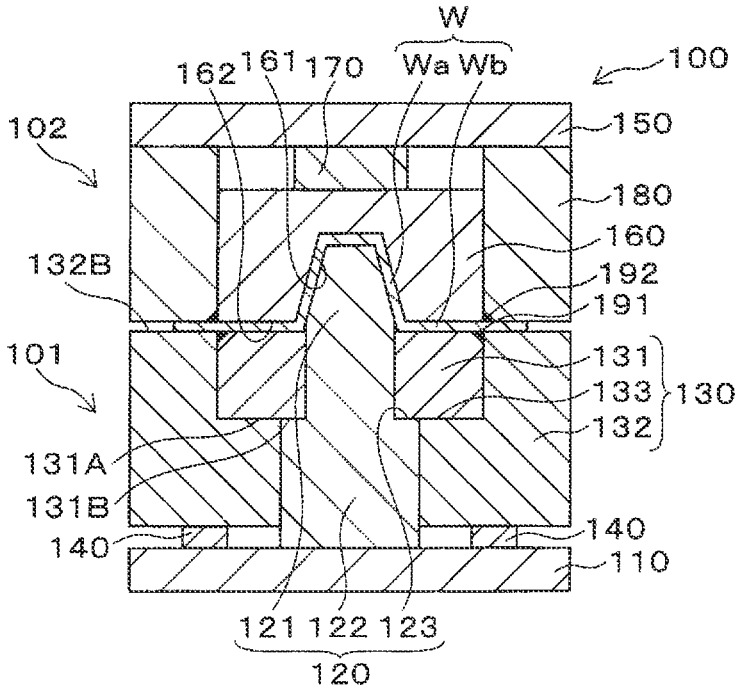
[FIG. 4]

At the drawing, the workpiece W flows in the concave portion 161 of the die part 160, and the tip portion of the punch 120 is completely inserted into the concave portion 161 of the die part 160 at a bottom dead center of the forming illustrated in FIG. 4, so that the top surface of the draw-shaped portion Wa of the workpiece W has a shape corresponding to the concave portion 161 of the die part 160. Simultaneously, the inner portion of the bottom surface of the first holder part 131 abuts on the top surface of the trimming support portion 123 of the punch 120.

Between the start and the completion of the drawing, since the first holder part 131 is supported by the drawing support portion 133 of the second holder part 132, the top surface of the first holder part 131 and the top surface of the second holder part 132 are maintained in the initial state, which configure the same plane. Meanwhile, since the downward biasing force of the cushion part 170 is set to be larger than the pressure of the drawing, the bottom surface of the end portion 162 of the die part 160 and the bottom surface of the trimming part 180 are maintained in the initial state, which configure the same plane. In this way, the lower trimming blade 191 and the upper trimming blade 192 are not exposed between the start and the completion of the drawing.

Figure 5:
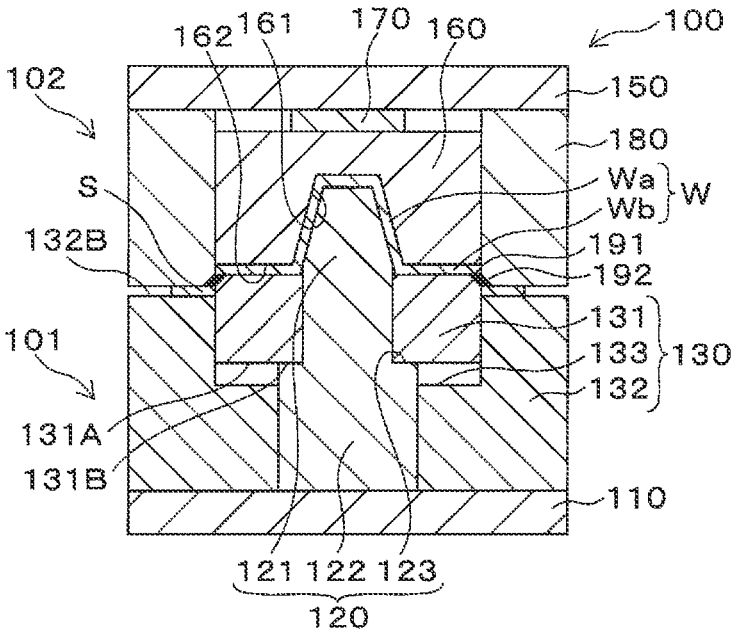
[FIG. 5]

Subsequently, when the upper die 102 is moved down, the cushion part 140 of the lower die 101 is further shrunk. In this instance, as illustrated in FIG. 5, for the lower die 101, the bottom surface of the first holder part 131 abuts on the top surface of the trimming support portion 123 of the punch 120, and the trimming support portion 123 supports the first holder part 131, instead of the drawing support portion 133 of the second holder part 132. Consequently, for the upper die 102, the die part 160 pushing down the first holder part 131 is not moved down, but the cushion part 170 of the upper die 102 starts to shrink, and the trimming part 180 is moved down with the second holder part 132. The second holder part 132 abuts on the lower die support part 110.

In this instance, for the lower die 101, the first holder part 131 is moved up relative to the second holder part 132, and thus the lower trimming blade 191 of the first holder part 131 is exposed. For the upper die 102, the trimming part 180 is moved down relative to the die part 160, and since the upper trimming blade 192 of the trimming part 180 is exposed, an outer end portion of a flange portion Wb of the workpiece W (formed product) is cut by the lower trimming blade 191 and the upper trimming blade 192, which performs the trimming process.

Figure 6:
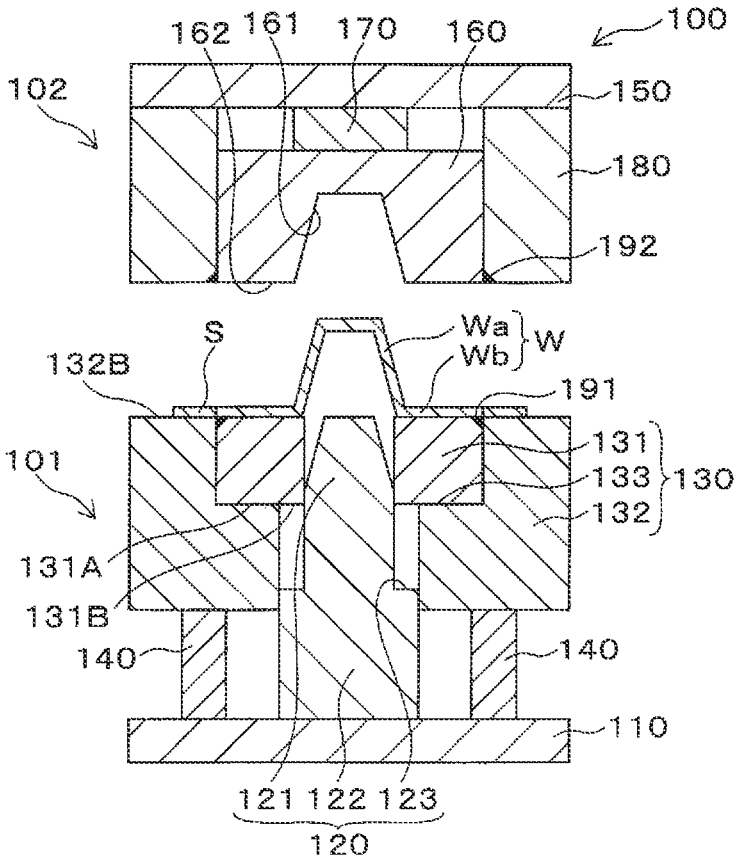
[FIG. 6]

After the trimming process is completed, when the upper die 102 is moved up, the cushion part 140 of the lower die 101 is expanded. For the blank holder 130, the second holder part 132 is biased and moved up by the cushion part 140 of the second holder part 132, and the first holder part 131 is supported and moved up by the drawing support portion 133 of the second holder part 132, so that the press-die 100 is returned to the initial state, as illustrated in FIG. 6. In this instance, for the workpiece W, the flange portion WB is supported and is moved up by the first holder part 131, and the draw-formed portion Wa is spaced apart from the tip portion of the punch 120. Further, the scrap S cut from the workpiece W is supported and is moved up by the second holder part 132, and the scrap S is spaced apart from the tip portion of the punch 120. Then, the workpiece W (formed product) and the scrap S are extracted from the press-die 100.

In the initial state of the first embodiment, the drawing support portion 133 supports the outer portion of the bottom surface (the first portion 131A of the bottom surface) of the first holder part 131, and the trimming support portion 123 is spaced apart from the inner portion of the bottom surface (the second portion 131B of the bottom surface) of the first holder part 131 in a direction opposite to the direction facing the upper die 102. Therefore, between the initial state and the drawing, the first holder part 131 can be moved toward the trimming support portion 123 of the punch 120 in the state in which the first holder part is supported by the drawing support portion 133 of the second holder part 132.

In this first embodiment, since the cushion part 140 supports the second holder part 132, and the drawing support portion 133 of the second holder part 132 supports the first holder part 131, the same load can be applied to the first holder part 131 and the second holder part 132 from the cushion part 140, so that the first holder 131 and the second holder 132 can be integrally moved. Further, it can make the load applied to the workpiece W from the first holder part 131 and the second holder part 132 uniform, or the load can be brought to be almost uniform. Furthermore, it is possible to suppress formation of a stepped portion between the top surface of the first holder part 131 and the top surface of the second holder part 132. Therefore, the quality of the draw-formed product can be improved.

In particular, since the exposure of the edge of the lower trimming blade 191 can be suppressed during the drawing, it is possible to suppress the edge from being worn when the material of the workpiece W flows in. Further, it is possible to suppress occurrence of a problem in the formed product is damaged, so that the appearance of the product becomes good.

In addition, after the trimming process is completed, the upper die 102 is moved in the direction opposite to the lower die 101, so that the press-die 100 can be returned to the initial state. In this instance, since the draw-formed portion Wa of the workpiece W and the scrap S can be spaced apart from the tip portion of the punch 120, the workpiece W and the scrap S can be easily extracted.

(3) Embodiment 2

Figure 8:
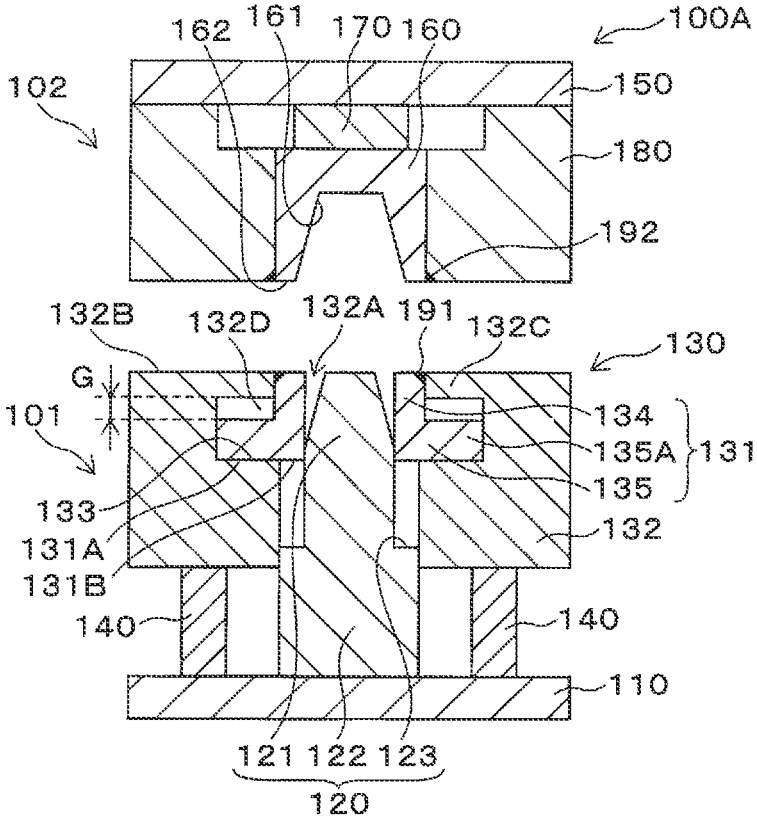
[FIG. 8]
Figure 9:
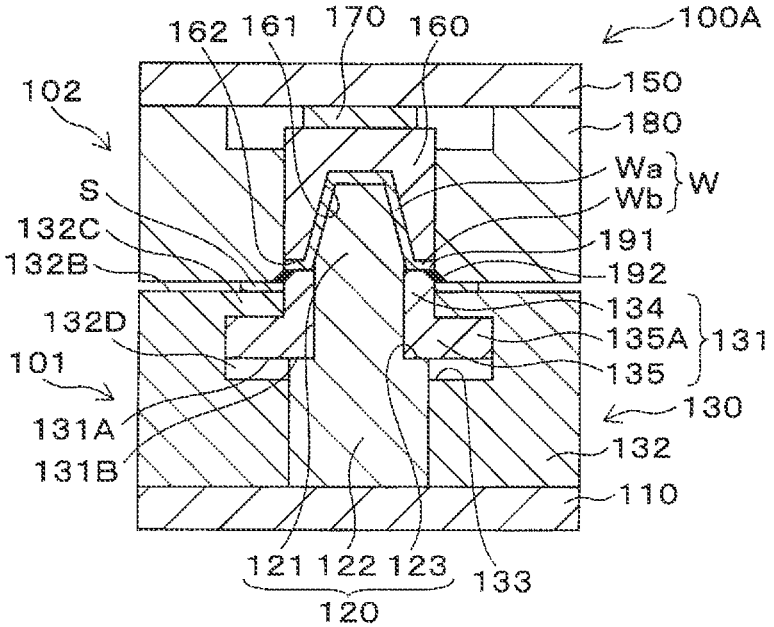
[FIG. 9]

The present invention is not limited to the first embodiment described above, but various modifications or variations are available. For example, when a press-die 100A of a second embodiment illustrated in FIGS. 8 and 9 is employed, the width of the flange portion Wb of the workpiece W can be set to be narrow. FIG. 8 is a side sectional view schematically illustrating the configuration of the press-die 100A according to the second embodiment. FIG. 9 is a side sectional view illustrating a state of the trimming process carried out by the press-die 100A in FIG. 8.

As illustrated in FIG. 8, the holder part 131 has a small-width portion 134 and a large-width portion 135. The light-width portion 135 is provided with a protrusion 135A protruding in a horizontal direction toward the second holder part 132, and the large-width portion 135 has a width larger than that of the small-width portion 134. An inner end portion of the top surface of the second holder part 132 is provided with a release preventing portion 132C for preventing the protrusion 135A of the large-width portion 135 from being released outwardly. The release preventing portion 132C is opposite for example to the drawing support portion 133, and has the same width as that of the drawing support portion 133. A concave portion 132D is formed between the release preventing portion 132C and the drawing support portion 133.

The protrusion 135A of the large-width portion 135 of the first holder part 131 is disposed in the concave portion 132D. In this instance, the side of the protrusion 135A is slidably moved on the inner side of the concave portion 132D, and the outer side of the small-diameter portion 134 is slidably moved on the side of the release preventing portion 132C. In the initial state in which the large-width portion 135 of the first holder part 131 is supported by the drawing support portion 133 of the second holder part 132, a gap of a predetermined interval is formed between the top surface of the large-width portion 135 and the bottom surface of the release preventing portion 132C. A size G of the gap is set to be equal to, for example, an interval between the bottom surface of the second holder part 132 and the top surface of the lower die support part 110 in FIG. 4.

In the press-die 100A, when the workpiece W is disposed on the lower die 101 and the upper die 102 is moved down, a similar draw process as the press-die 100 illustrated in FIGS. 2 to 4 is carried out. In the trimming process after the draw process, as illustrated in FIG. 9, the inner portion of the bottom surface (the second portion 131B of the bottom surface) of the large-width portion 135 of the first holder part 131 is supported by the trimming support portion 123 of the punch 120. When the cushion part 140 is contracted, the second holder part 132 is moved down, while the first holder part 131 is moved up relative to the second holder part 132. In this instance, the side of the protrusion 135A of the large-width portion 135 is slid on the inner side of the concave portion 132D, and when the second holder part 132 abuts on the lower die support part 110, the top surface of the protrusion 135A of the large-width portion 135 abuts on the bottom surface of the release preventing portion 132C.

In the above aspect, when the width of the flange portion Wb of the workpiece W is set to be narrow, it is not necessary to make the width of the outer portion of the bottom surface (the first portion 131A of the bottom surface) of the first holder part 131 and the width of the drawing support portion 133 of the second holder part 132 narrow. Therefore, it is possible to effectively apply the load to the workpiece W from the first holder part 131 through the second holder part 132, similar to the first embodiment. Accordingly, in the case where the width of the flange portion Wb of the workpiece W is set to be narrow, the first holder part 131 and the second holder part 132 can be integrally moved, and it is possible to make the load applied to the workpiece W from the first holder part 131 and the second holder part 132 uniform.

According to embodiments, the press-die 100, 100A may include the lower die 101 for supporting the workpiece W, and the upper die 102 disposed to face to the lower die 101.

The lower die 101 may have the drawing punch 120, the blank holder 130 disposed to be movable along the side surface of the drawing punch 120, and the cushion part 140 biasing the blank holder 130 toward the upper die 102.

The upper die 102 may have the drawing die part 160 disposed to face to the drawing punch 120, and the trimming part 180 disposed to be movable along the side surface of the drawing die part 160.

The blank holder 130 may have the first holder part 131 disposed to face to the end portion 162 of the drawing die part 160, and the second holder part 132 disposed to face to the trimming part 180 and biased by the cushion part 140.

The second holder part 132 may have the drawing support portion 133 to support the first portion 131A of the bottom surface of the first holder part 131.

The drawing punch 120 may have the trimming support portion 123 to support the second portion 131B of the bottom surface of the first holder part 131.

The first holder part 131 may have the lower trimming blade 191 at the outer edge thereof.

The trimming part 180 may have the upper trimming blade 192 at the inner edge thereof.

In the press-die according to embodiments, when the upper die is moved toward the lower die at the initial state, the workpiece is sandwiched between the top surface of the first holder part and the bottom surface of the end portion of the drawing die part, and the top surface of the second holder part and the bottom surface of the trimming part. In the lower die, the cushion part biasing the second holder part of the blank holder is contracted, and the blank holder (the first holder part and the second holder part) is moved together with the trimming part and the drawing die part of the upper die. Therefore, the workpiece is pressed to the drawing punch by the concave portion of the drawing die part, and thus the workpiece flows in the concave portion of the drawing die part, so that the drawing is carried out. in this instance, in the initial state, since the drawing support portion supports the first portion of the bottom surface of the first holder part, and the trimming support portion is separated from the second portion of the bottom surface of the first holder part in a direction opposite to the direction facing the upper die, the first holder part can be moved toward the trimming support portion of the drawing punch, between the initial state and the drawing, in the state in which the first portion of the bottom surface of the first holder part is supported by the drawing support portion of the second holder part.

In the press-die according to embodiments, since the second holder part is supported by the cushion part, and the first holder part is supported by the drawing support portion of the second holder part, the same load can be applied to the first holder part and the second holder part from the cushion part, so that the first holder part and the second holder part are integrally moved. Further, it can make the load applied to the workpiece from the first holder part and the second holder part uniform, or the load can be brought to be almost uniform. Furthermore, it is possible to suppress formation of a stepped portion between the top surface of the first holder part and the top surface of the second holder part. Therefore, the quality of the draw-formed product can be improved.

In particular, since the exposure of the edge of the lower trimming blade can be suppressed during the drawing, it is possible to suppress the edge from being worn when the material of the workpiece flows in. Further, it is possible to suppress occurrence of a problem in the workpiece (formed product) is damaged, so that the appearance of the product becomes good.

The press-die of embodiments may employ various configurations. For example, the first holder part includes a small-width portion opposite to the drawing die part, and a large-width portion formed at an end portion of the small-diameter portion opposite to the drawing die part and having a protrusion protruding toward the second holder part, wherein the inner end of the top surface of the second holder part is provided with a release preventing portion for preventing the large-width portion from being released outward, a concave portion is formed between the drawing support portion and the release preventing portion, and the protrusion of the large-width portion is disposed in the concave portion so that it is slidably moved in a direction opposite to the moving direction of the second holder part. In this instance, the inner means an inner side of the press-die, while the outer means an outer side of the press-die. In this aspect, when the width of the flange portion of the workpiece is set to be narrow, it is not necessary to make the width of the outer portion of the bottom surface (the first portion of the bottom surface) of the first holder part and the width of the drawing support portion of the second holder part narrow. Therefore, when the width of the flange portion of the workpiece is set to be narrow, the load applied to the workpiece from the first holder part and the second holder part can be uniform or substantially uniform.

According to embodiments, the press working method may include a process of moving the upper die 102 toward the lower die 101, so that the workpiece W is sandwiched between the top surface of the first holder part 131 of the lower die 101 and the bottom surface of the end portion 162 of the drawing die part 160 of the upper die 102, and the top surface of the second holder part 132 of the lower die 101 and the bottom surface of the trimming part 180 of the upper die 102, and the drawing punch 120 of the lower die 101 is inserted into the concave portion 161 of the drawing die part 160, thereby performing the drawing on the workpiece W, and after the drawing, a process of moving the upper die 102 toward the lower die 101, so that the trimming part 180 is moved toward the lower die 101 relative to the drawing die part 160, and the second holder part 132 is moved together with the trimming part 180, thereby performing the trimming process on the workpiece W by the lower trimming blade 191 of the first holder part 131 and the upper trimming blade 192 of the trimming part 180.

At the time of the drawing process, in the state in which the first portion 131A of the bottom surface of the first holder part 131 is supported by the drawing support portion 133 of the second holder part 132, the first holder part 131 is moved toward the trimming support portion 123 of the drawing punch 120 by the drawing die part 160. When the drawing is completed, the second portion 131B of the bottom surface of the first holder part 131 may abut on the trimming support portion 123.

At the time of the trimming process, the second portion 131B of the bottom surface may be supported by the trimming support portion 123, and the first portion 131A of the bottom surface may be spaced apart from the drawing support portion 133.

The press working method of the embodiments can achieve the effect of improving the quality of the formed product.

The press working method of embodiments can employ various configurations. For example, after the trimming process, as the upper die is moved in a direction opposite to the direction facing the lower die, the blank holder is returned to the initial state to extract the workpiece. In this aspect, when the press-die is returned to the initial state after the trimming process, since the flange portion of the workpiece (formed product) is supported by the first holder part and thus is moved up relative to the punch, the draw-formed portion of the workpiece is spaced apart from the tip portion of the punch. As a result, the workpiece can be easily extracted. Further, since the scrap cut from the workpiece is supported by the second holder part and thus is moved up relative to the punch, the scrap can be easily extracted.

According to the press-die or the press working method of embodiments, it can obtain the effect of improving the quality of the formed product.

DESCRIPTION OF REFERENCE NUMERALS

100, 100A . . . Press-Die, 101 . . . Lower Die, 102 . . . Upper Die, 102 . . . Punch (Drawing Punch), 130 . . . Blank Holder,

131 . . . First Holder Part, 131A . . . First Portion of Bottom Surface, 131B . . . Second Portion of Bottom Surface, 132 . . . Second Holder Part, 133 . . . Drawing Support Portion, 140 . . . Cushion Part, 160 . . . Drawing Die Part, 161 . . . Concave Portion, 162 . . . End Portion, 180 . . . Trimming Part, 191 . . . Lower Trimming Blade, 192 . . . Upper Trimming Blade

The invention claimed is:

1. A press-die comprising:

a lower die configured to support a workpiece; and an upper die disposed to face the lower die, wherein the lower die includes:

a drawing punch;

a blank holder disposed to be movable along a side surface of the drawing punch; and a cushion part pressing the blank holder toward the upper die, wherein the upper die includes:

a drawing die part disposed to face the drawing punch; and a trimming part disposed to be movable along a side surface of the drawing die part, wherein the blank holder includes:

a first holder part disposed to face an end portion of the drawing die part; and a second holder part disposed to face the trimming part and biased by the cushion part, wherein the second holder part has a drawing support portion that supports a first portion of a bottom surface of the first holder part, wherein the drawing punch has a trimming support portion that supports a second portion of the bottom surface of the first holder part, wherein the first holder part has a lower trimming blade at an outer edge thereof, and wherein the trimming part has an upper trimming blade at an inner edge thereof.

2. A press working method comprising:

performing a drawing process on a workpiece by moving an upper die toward a lower die so that the workpiece is sandwiched between a top surface of a first holder part of the lower die and a bottom surface of an end portion of a drawing die part of the upper die and between a top surface of a second holder part of the lower die and a bottom surface of a trimming part of the upper die, and the drawing punch of the lower die is inserted into a concave portion of the drawing die part; and performing a trimming process on the workpiece, after the drawing process, by a lower trimming blade of the first holder part and an upper trimming blade of the trimming part, by moving the upper die toward the lower die so that the trimming part is moved toward the lower die relative to the drawing die part and the second holder part is moved together with the trimming part, wherein during the drawing process, in a state in which a first portion of a bottom surface of the first holder part is supported by a drawing support portion of the second holder part, the first holder part is moved toward a trimming support portion of the drawing punch by the drawing die part, and the second portion of the bottom surface of the first holder part abuts on the trimming support portion when the drawing is completed, and wherein during the trimming process, the second portion of the bottom surface is supported by the trimming support portion, and the first portion of the bottom surface is spaced apart from the drawing support portion.

3. The press working method according to claim 2, wherein after the trimming process, by moving the upper die in a direction opposite to a direction toward the lower die, the blank holder is returned to an initial state, and the workpiece is extracted.

* * * * *